US008134429B2

(12) United States Patent
Harling

(10) Patent No.: US 8,134,429 B2
(45) Date of Patent: Mar. 13, 2012

(54) ELECTRICAL APPLIANCE HAVING AN ELECTRICAL CONNECTION

(75) Inventor: Oliver Harling, Oyten (DE)

(73) Assignee: Siemens Aktiengesellschaft, Munich (DE)

( * ) Notice: Subject to any disclaimer, the term of this patent is extended or adjusted under 35 U.S.C. 154(b) by 120 days.

(21) Appl. No.: 12/588,159

(22) Filed: Oct. 6, 2009

(65) Prior Publication Data

US 2010/0087070 A1 Apr. 8, 2010

(30) Foreign Application Priority Data

Oct. 7, 2008 (DE) ..... 10 2008 050 755

(51) Int. Cl.
*H01H 1/00* (2006.01)

(52) U.S. Cl. ..... 335/196; 335/6; 335/12; 335/83; 335/106; 335/133; 200/237; 200/254; 200/275

(58) Field of Classification Search ..... 335/6, 12, 335/15, 46, 57, 60, 83, 106, 121, 133, 196; 200/237, 244, 248–249, 254, 271–275, 286, 200/401; 439/12, 38, 39, 822
See application file for complete search history.

(56) References Cited

U.S. PATENT DOCUMENTS

| | | | | |
|---|---|---|---|---|
| RE18,630 | E | 10/1932 | Van Sickle | |
| 1,978,246 | A * | 10/1934 | Bauerschmidt | 200/255 |
| 2,032,149 | A * | 2/1936 | Rawlins | 218/90 |
| 2,254,720 | A * | 9/1941 | Wilcox | 200/272 |
| 2,471,608 | A * | 5/1949 | Caswell | 200/244 |
| 3,137,778 | A * | 6/1964 | Barr | 200/259 |
| 3,174,024 | A * | 3/1965 | John et al. | 200/244 |
| 4,445,732 | A | 5/1984 | Wafer | |
| 4,880,948 | A * | 11/1989 | Kandatsu et al. | 218/117 |
| 4,890,081 | A * | 12/1989 | McKee et al. | 335/18 |
| 5,004,878 | A * | 4/1991 | Seymour et al. | 218/155 |
| 5,130,560 | A * | 7/1992 | Morishita et al. | 290/38 R |
| 5,146,194 | A * | 9/1992 | Altenhof et al. | 335/16 |
| 5,566,818 | A * | 10/1996 | Kuboyama et al. | 200/271 |
| 6,534,737 | B1 * | 3/2003 | Rademacher et al. | 200/401 |
| 6,878,890 | B1 * | 4/2005 | Stay et al. | 200/244 |
| 7,667,150 | B2 * | 2/2010 | Robbins et al. | 200/244 |
| 7,777,601 | B2 * | 8/2010 | Kakisako et al. | 335/196 |
| 2006/0145403 | A1 * | 7/2006 | Oohashi | 267/75 |

FOREIGN PATENT DOCUMENTS

| | | | |
|---|---|---|---|
| DE | 676 648 | | 6/1939 |
| DE | 1 197 160 | | 7/1965 |
| DE | 1 540 508 | A1 | 1/1970 |
| DE | 1 927 783 | A1 | 12/1970 |
| DE | 3125766 | A1 * | 1/1983 |
| DE | 103 47 148 | A1 | 5/2005 |
| GB | 740476 | | 11/1955 |

* cited by examiner

*Primary Examiner* — Mohamad Musleh
(74) *Attorney, Agent, or Firm* — Harness, Dickey & Pierce, P.L.C.

(57) ABSTRACT

An electrical appliance designed according to the principle of a fork connection, and into which a contact element is insertable between two contact clips. In the event of high currents, such as those which can occur in the event of short circuits in a load which is connected to the fork connection, magnetic forces counteract current constriction forces, thus allowing higher currents to be carried through the connection without the contact clips being bent apart from one another in the process. This is achieved in that a magnetic field caused by a current is concentrated in a particularly advantageous manner for production of forces which draw the two clip contacts together with the aid of a part at least partially composed of a ferromagnetic material, one of which in at least one embodiment, is arranged between the contact clips.

9 Claims, 3 Drawing Sheets

ELECTRICAL APPLIANCE HAVING AN ELECTRICAL CONNECTION

PRIORITY STATEMENT

The present application hereby claims priority under 35 U.S.C. §119 on German patent application number DE 10 2008 050 755.5 filed Oct. 7, 2008, the entire contents of which are hereby incorporated herein by reference.

FIELD

At least one embodiment of the invention generally relates to an electrical appliance having an electrical connection. In particular, in at least one embodiment, an electrical appliance such as this should be understood as meaning a circuit breaker.

BACKGROUND

One particularly simple embodiment of connections for electrical appliances is plug contacts, in which there is only a force fit between a connecting contact on the appliance side, and a plug to be connected thereto. One advantage of plug contacts is that the electrical connection can be made simply by plugging the plug into the connecting contact, and can be disconnected again by pulling the plug out of the connecting contact. So-called fork or lyre contacts represent one form of plug contacts.

One example of a fork contact such as this according to the prior art is illustrated in the form of a schematic perspective view in FIG. 1. In the case of fork contacts, one side of the connection, preferably the connection on the appliance side, is formed by two contact clips 10, 12, which are arranged at a distance from one another. A so-called blade contact 14 of the further appliance can be inserted between the two connecting clips 10, 12, in order to make an electrical contact with a further appliance.

In order to make it easy to insert the blade contact 14 between the two contact clips 10, 12, particular shapes may be provided on contact areas 16 of the two contact clips 10, 12. In the example shown in FIG. 1, the contact clips 10, 12 are attached to a contact arm 18 of the electrical appliance, which is not illustrated. A total current G emitted from the electrical appliance flows via the contact arm 18 to the fork contact, where is it is split between the two contact clips 10, 12 and thus passed to the contact areas 16, forming two current paths which run in parallel. The two current elements merge at the contact areas 16 into the blade contact 14, thus once again resulting in the total current G in the blade contact 14, which is then carried away in the blade contact 14.

FIG. 1 shows only parts of the contact arm 18 and of the blade contact 14, as a result of which neither the source of the total current G nor its sink can be seen.

The total current G should be transferred from the contact arm 18 to the blade contact 14 with losses that are as low as possible. Particularly in the event of a short circuit, when the total current G transmitted via the fork contact and therefore also the transmitted electrical power are above the maximum permissible level, it is of major importance for the proportion of this transmitted power which was produced as lost power in the fork contact to be sufficiently low but the fork contact is not damaged by heating in the event of a short circuit. In this context, particularly the contact surfaces of the contact areas 16 of the two contact clips 10, 12 with the blade contact 14 have a tendency not to rest completely on the blade contact because of uneven areas on the surfaces of the contact areas

16, with only subregions allowing the total current G to be transmitted from the contact clips 10, 12 to the blade contact 14. Electrical losses lead to heating at such current constrictions, where the total current passes through a relatively small cross section.

In addition, forces F, F' occur at contact constrictions and force the contact areas 16 of the contact clips 10, 12 away from the blade contact 14. Forces such as these are referred to as current constriction forces or Holm forces, and result in constrictions of current paths. Current constriction forces are Lorentz forces which are formed on both sides of a constriction of a current path, because of currents running in opposite directions. If current constriction forces F, F' lead to the contact areas 16 being moved away from the blade contact 14, the current transmission areas are constricted further. In consequence, the current constriction forces F, F' increase further resulting first of all in one of the two contact clips 10, 12 lifting off. Since the total current G is now carried completely by the contact clip which is still in contact, the current constriction forces F, F' on its contact area 16 increase once again, and the remaining contact clip 10, 12 is also disconnected from the blade contact 14. This leads to arc formation, heating of the fork contact and (in the worst case) to fusing of the contact areas 16 to the blade contact 14, that is to say to destruction of the fork contact.

Since the current constriction areas on the contact areas 16 of each contact clip 10, 12 are different, different contact resistances are formed between the blade contact 14 and a respective contact clip 10, 12, as a result of which the total current G is not distributed uniformly between the two contact clips 10, 12 but, in some circumstances, one of the two contact clips 10, 12 carries a greater current. It has been found from investigations that, in extreme cases, it is possible for one of the contact clips 10, 12 to carry up to 80% of the total current G, while only the remaining 20% of the total current G flows in the second contact clip 10, 12. In a corresponding manner, greater current constriction forces F, F' act from the start on the contact clip 10, 12 carrying the greater proportion of the current. In consequence, the process as just described of disconnecting one contact clip first of all followed by subsequent disconnect of the remaining contact clip, with the described destructive consequences, is assisted by the asymmetric current distribution.

The occurrence of current constrictions in the contact areas 16 can be reduced by forcing the two contact clips 10, 12 toward one another, whilst resulting in a pressure force of the contact areas 16 on the blade contact 14, and thus improving the electrical contact between the contact areas 16 and the blade contact. However, the two contact clips 10, 12 cannot be forced toward one another until the blade contact 14 has been inserted since, otherwise, the insertion process would itself be made more difficult. In this context, fork contacts have the advantage that the required pressure force is produced by the total current G itself: since the total current G is carried through the two contact clips 10, 12 on two current paths which run in parallel, this results in a magnetic field H which surrounds the two contact clips 10, 12 and which in turn results in a force which forces the two contact clips 10, 12 toward one another in the desired manner.

The force produced by the field H which surrounds the two contact clips 10, 12 is increased, according to the prior art, by placing two magnetically permeable brackets 20, 22 around the two contact clips 10, 12. The two brackets 20, 22 are separated from one another by two air gaps 24, 26. Magnetically permeable brackets should in the present case be understood as meaning that these brackets are manufactured at least partially from a material having high magnetic permeability (preferably with a relative permeability of more than two).

Magnetically permeable elements are preferably manufactured from ferromagnetic material, in particular so-called construction steel (steel 1010).

In order to explain the effect of the two brackets 20, 22, FIG. 2 shows a section through the arrangement illustrated in FIG. 1. The section in this case runs along the line II-II shown in FIG. 1. FIG. 2 therefore shows cross sections through the two contact clips 10, 12 and cross sections through the two magnetically permeable brackets 20, 22. The total current G in the contact clips 10, 12 is split into two current elements I, I' flowing in a direction at right angles to the plane of the drawing in FIG. 2, as indicated by vertical direction arrows (circles with dots in them). The magnetic field H formed by the two current elements I, I' causes a magnetic flux B in the interior of the brackets 20, 22, which magnetic flux B appears as a magnetic flux density field B' in the gaps 24, 26 as it passes between the brackets 20, 22. The flux density field B' which is formed between the two boundary surfaces of a gap 24 and 26 results in a force on these surfaces, that is to say the two brackets 20, 22 attract one another, attempting to close the gaps 24, 26. Since the two contact clips 10, 12 are resting on the brackets 20, 22, the magnetically permeable brackets 20, 22 will result in an additional force, which forces the two contact clips 10, 12 together, being present when a current flows.

Since the flux density field B' running in the gaps 24, 26 is formed only when the fork connection is carrying current, the two brackets 20, 22 are attracted to one another only when current is actually flowing via the fork connection. It is therefore possible to easily insert a blade contact into the fork connection, and to detach it therefrom again, when the appliances are switched off. Since the two brackets 20, 22 would have fallen away from the contact clips 10, 12 when no field B' is present, they are mechanically secured by a holding clip 28.

Inter alia, the force acting on the contact clips 10, 12 as a result of the apparatus comprising the two magnetically permeable brackets 20, 22 is highly dependent on the width of the gaps 24, 26, that is to say on the distance between the two brackets 20, 22. This has the disadvantageous consequence that the gaps 24, 26 are also at the same time enlarged in the situation when one of the contact clips 10, 12 has been raised slightly off the blade contact 14 as a result of a current constriction force F, F'. Since this results in a reduction in the forces between the brackets 20, 22, that is to say the force counteracting the current constriction force F, F' is decreased, the contact clip which is initially only slightly raised is forced further away from the blade contact 14, and the destructive consequences that have already been described can occur. In this case as well, the total current G is once again split asymmetrically into the two current elements I, I' in the contact clips 10, 12, in a particularly disadvantageous manner.

It is known from simulations that, with the described fork contact from the prior art, and when the total current G is split asymmetrically, a total current level of more than 30 kA can lead to the described destructive effects of the current constriction forces F, F'. In the case of relatively large electrical appliance, particularly in the field of appliances with a low-voltage supply and correspondingly high operating currents, a total current of more than 30 kA can occur, however, in the event of a short circuit, before circuit breakers interrupt the short-circuit current. It is therefore possible in a situation such as this for a fork contact according to the prior art to be destroyed.

SUMMARY

In at least one embodiment of the present technical invention, an electrical appliance having an electrical connection is provided, in which detachment of contact clips of a fork contact from an inserted contact element as a result of current constriction forces is efficiently prevented.

Advantageous refinements of the electrical appliance according to the invention are described.

According to at least one embodiment of the invention the current constriction forces which act on two contact clips that are arranged at a distance from one another can be counteracted in a better manner in that at least a portion of a body which is composed at least partially of a ferromagnetic material is located between the contact clips. By way of example, a body such as this can be formed from the already mentioned construction steel or from electrical laminates or dynamo laminates (for example M 400-50-A). The arrangement of a magnetically permeable body between the two contact clips of a fork connection results in significantly better mechanical coupling between the two contact clips than in the case of the magnetic brackets as are used in the prior art. In particular, this results in an attraction force between in each case one contact clip and the ferromagnetic body. In consequence, it is not possible for the magnetic forces to be greatly reduced by one of the two contact clips being raised slightly, as can occur in the manner described above by the enlargement of the gaps between the brackets in the case of fork connection from the prior art.

A further advantage of the connection according to at least one embodiment of the invention is that the arrangement of the body between the contact clips means that less physical space is required than in the case of an electrical fork connection from the prior art, in which magnetically permeable brackets are arranged around the two contact clips.

The electrical connection according to at least one embodiment of the invention can be implemented in a particularly simple manner by the body having an H-profile cross section. In consequence, it can be suspended easily between the two contact clips without any further attachment apparatuses, resting on two of the limbs of the H-profile. It therefore need not be mechanically secured in a particular manner even in the situation when no current is flowing through the two contact clips.

The field which is caused by a current flowing through the two contact clips can be utilized even better to produce a force resulting in the two contact clips attracting one another in that a further body, which is composed at least partially of a ferromagnetic material, is arranged on one side of the respective contact clip on in each case one or on both contact clips, and faces away from the respective other contact clip. In consequence, the magnetic field is likewise carried within the magnetically permeable material on both sides of the fork connection. This results in reduced scattering losses from the magnetic field. In this case, scattering losses should be understood as meaning the lines of force of the magnetic field, which is formed by the current through the two contact clips, extend over a large area around the fork contact, thus magnetizing other components.

The magnetic field which is passed through at least one further body can be used to produce an additional force on one of the contact clips by forming at least one gap between the further body and the first body. In consequence, it is possible in the manner that has already been described to use the creation of a gap between two magnetically permeable bodies to ensure that these bodies attract one another when a magnetic field is formed in the gap. In consequence, a contact clip does not just drag itself, by virtue of the magnetic field surrounding it in the direction of the first magnetically permeable body which is located between the contact clips, but the second body, which is arranged in such a manner that the corresponding contact clip is located between it and the first body, exerts an additional force on the contact clip in the direction of the first body. A further body can be arranged on both sides of the fork contact.

BRIEF DESCRIPTION OF THE DRAWINGS

The invention will be described in the following text with reference to example embodiments. In the figures.

DETAILED DESCRIPTION OF THE EXAMPLE EMBODIMENTS

Figure 1:
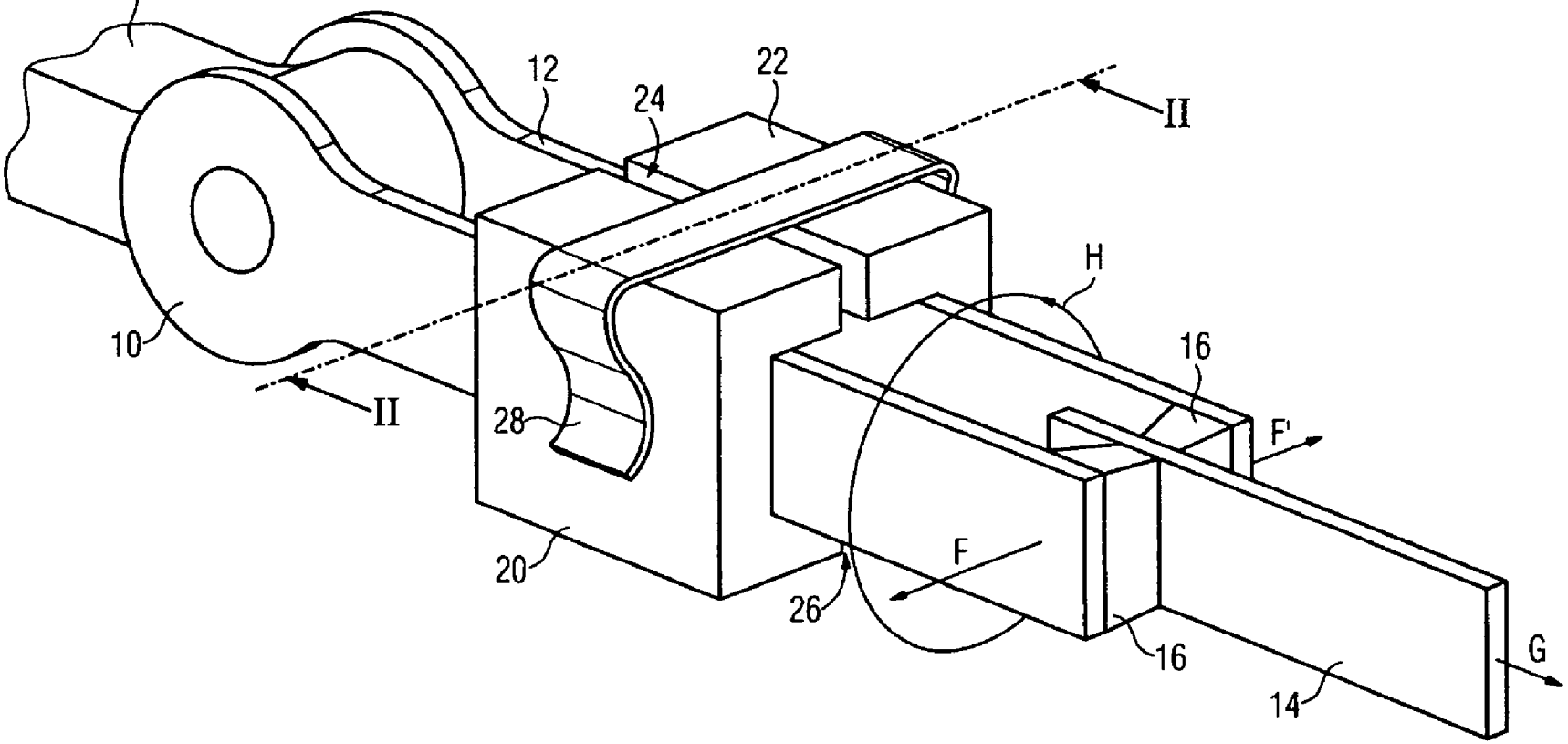
FIG 1 (Prior art)
FIG. 1 shows a perspective illustration of a fork contact according to the prior art.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

Figure 2:
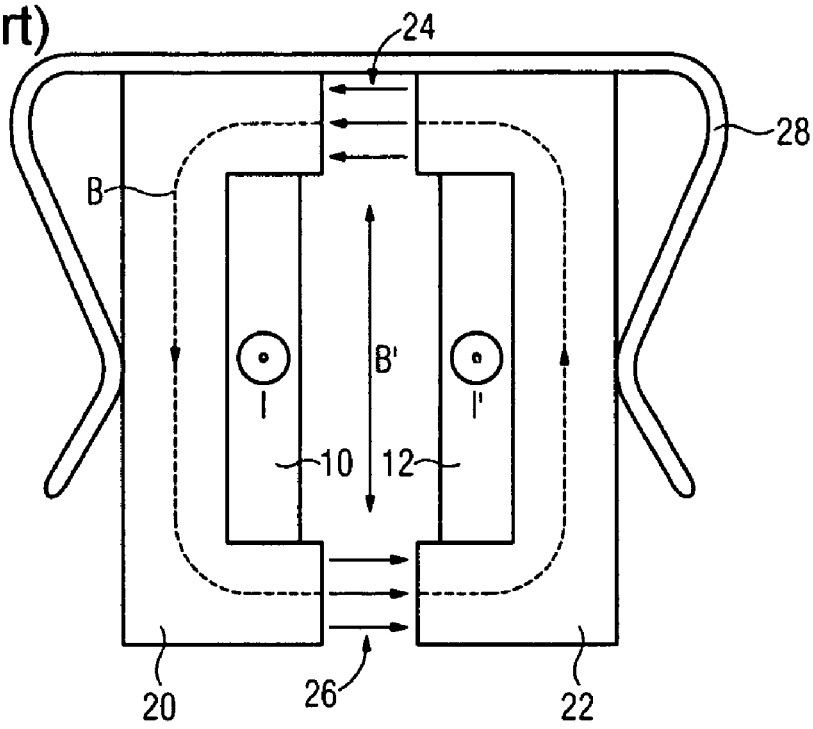
FIG 2 (Prior art)
FIG. 2 shows a cross section through the fork contact shown in FIG. 1.
Figure 3:
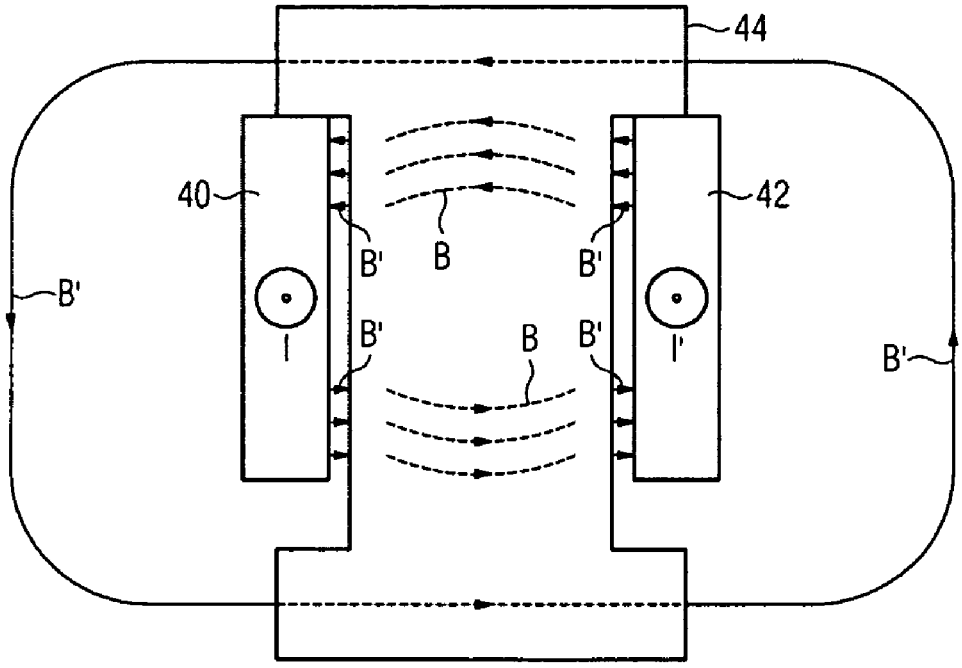
FIG. 3 shows a cross section through an arrangement comprising two contact clips and a body located between them according to a first embodiment of the invention.

FIG. 3 shows a cross section through an arrangement according to the invention comprising two contact clips 40, 42 and a body 44 which is located between them and is composed of ferromagnetic material. The cross section corresponds to the cross section as is shown in FIG. 2, in which the arrangement of the brackets 20, 22, as is known from the prior art, and the holding clip 28 is replaced by a body 44. The body has an H-profile, with its two upper limbs resting on a respective contact clip 40, 42. It therefore need not be mechanically secured against falling out even in the situation in which no current is flowing through the two contact clips 40, 42.

A current element I, I' respectively flows through the contact clips 40, 42 illustrated in FIG. 3, with these current elements I, I' flowing in a direction at a right angle out of the plane of the drawing in FIG. 3. This is symbolized by corresponding direction vectors in the form of circles with a marked center point. The two current elements I, I' result in the two contact clips 40, 42 being surrounded by a magnetic field which in turn causes a magnetic flux density field B in the ferromagnetic body 44. The profile of the lines of force of the flux density field B is illustrated by dashed lines. The lines of force of the flux density field B run outside the body as a flux density field B'. Since a portion of this field runs between in each case one of the contact clips 40, 42 on one side and the ferromagnetic body 44, this results, in the manner already described in a force acting between the contact clips 40, 42 and the ferromagnetic body 44. This results in each of the two contact clips 40, 42 being subjected to a force, which compensates for the current constriction forces, independently of the respective other contact clip 40, 42.

Figure 4:
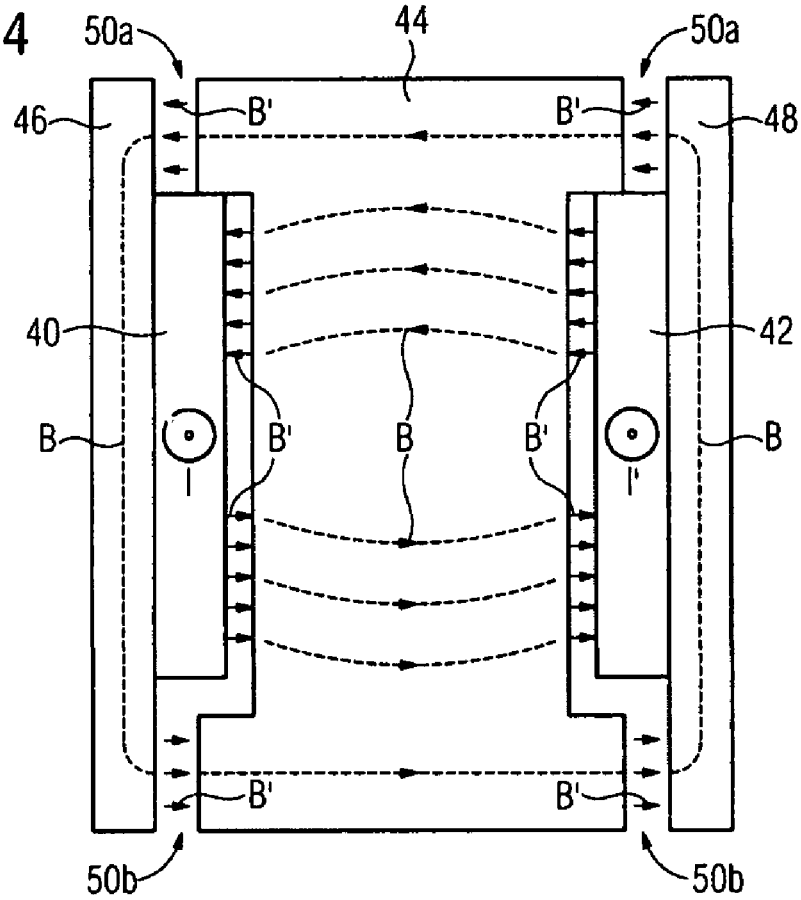
FIG. 4 shows a cross section through an arrangement comprising two contact clips, a body located between them and two further plates, according to a second embodiment of the invention.

FIG. 4 shows a cross section through an arrangement according to the invention having the elements which have already been illustrated in FIG. 3 with the arrangement illustrated in FIG. 4 additionally having two further, magnetically permeable plates 46, 48. These two plates 46, 48 represent a second and a third body which, together with the body 44, form a device which is used to carry the magnetic field.

In this case, the plate 46 is arranged on the side of the contact clip 40 facing away from the contact clip 42. The plate 48 is arranged in the same manner on the side of the contact clip 42 facing away from the contact clip 40. Two gaps 50*a*, 50*b* are respectively formed between each of the plates 46, 48 and the body 44 which is located between the contact clips 40, 42.

As a comparison with the arrangement illustrated in FIG. 3 will show, the plates 46, 48 which are arranged externally on the arrangement comprising the contact clips 40, 42 and the ferromagnetic body 44 result in the magnetic flux density field no longer extending further than the external field B' around the arrangement, but with the majority running as the field B in the interior of the magnetically permeable material of the parts 40, 46, 48. The majority of that component of the magnetic flux density field which runs outside the material is concentrated as flux density field B' in the gaps 50*a*, 50*b*. Remaining scattering fields are not illustrated in FIG. 4, since they lead to only insignificant losses. The flux density field B' running in the gaps 50*a*, 50*b* results in the plates 46, 48 being attracted in the direction of the body 44. Since the plates 46, 48 are resting on the contact clips 40, 42, a force is therefore exerted directly on the contact clips 40, 42, forcing the two contact clips 40, 42 together. An additional force is therefore produced, which can counteract the current constriction forces. The plates 46, 48 are attached via sprung hooks to a contact arm which is not illustrated in the figure, in such a way that they are held in their position on the contact clips 40, 42 even when no current is flowing through the contact clips 40, 42.

A fork connection according to the invention, as is illustrated in FIG. 4, is able to carry a total current G which comprises the currents I and I' as illustrated in FIG. 4 and has a current level of 80 kA, before the current constriction forces at the junction between the contact clips 40, 42 and the blade contact predominate, as is shown for example in FIG. 1. A simulation in the same conditions, but with a fork contact as is illustrated in FIG. 2, resulted in the already mentioned 30 kA as the maximum total current G which can be transmitted. This simulation illustrates that the electrical connection according to the invention is able to transmit a short-circuit current of virtually three times the magnitude, without damage.

Figure 5:
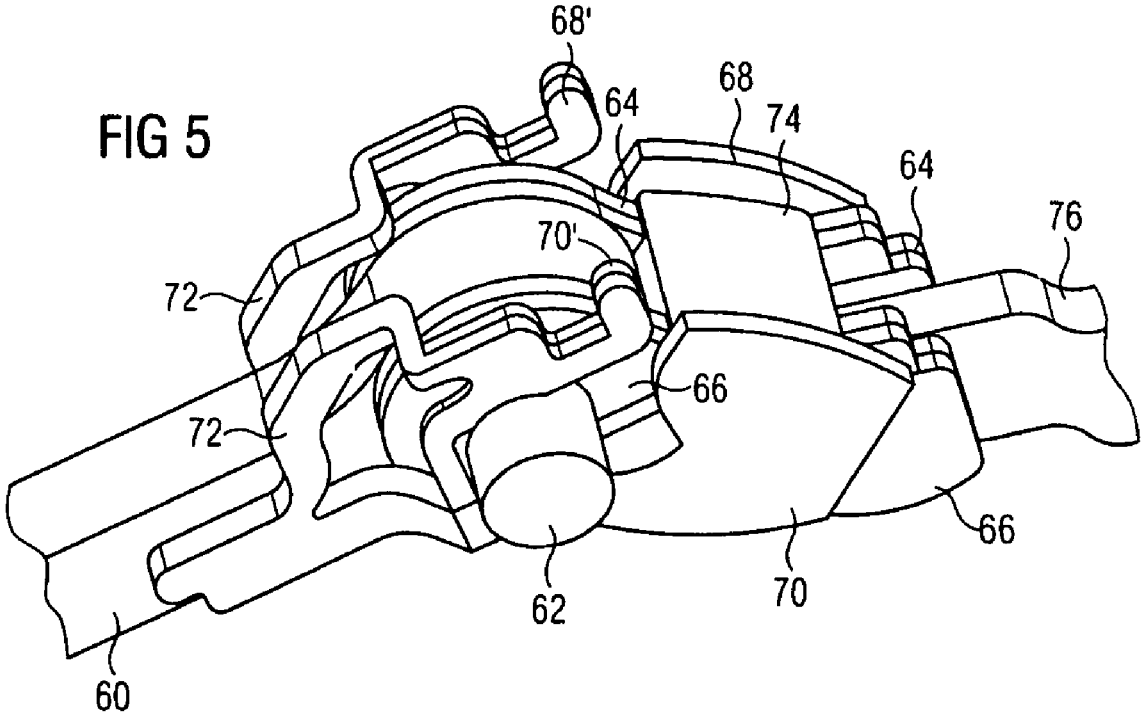
FIG. 5 shows a detail, perspective illustration of a fork contact, which is used and provided according to an embodiment of the invention, of a circuit breaker.

FIG. 5 shows a perspective illustration of a connection according to the invention, which belongs to a circuit breaker. FIG. 5 illustrates only a portion of a contact arm 60 which is composed of copper and is itself part of the circuit breaker. An eye is formed on the contact arm, and a bolt 62 is passed through it. A plurality of elements are mounted on the contact arm 60, such that they can pivot, via the bolt 62. These are, on the one hand, two contact clips 64, 66 which are likewise manufactured from copper. Furthermore, two plates 68, 70 are held via hooks 68' 70' formed on the plates. Finally, the arrangement is moved in a predetermined manner by a contact bracket 72, during pivoting movements of the contact arm 60. A magnetically permeable body 74 is introduced between the two contact clips 64, 66, is manufactured from construction steel, in the same way as the two plates 68, 70, and has an H-profile. A blade contact 76, only part of which can be seen in FIG. 5, is inserted into the connection of the circuit breaker, as illustrated in FIG. 5.

If FIGS. 1 and 2 are compared with FIGS. 3 to 5, it can be seen that an electrical appliance according to an embodiment of the invention with an electrical connection according to an embodiment of the invention can be implemented in a compact manner, that is to say without requiring any additional physical space, and can nevertheless transmit a considerably greater total current via the connection, without the connection being damaged in the process.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combineable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A switching device having an electrical connection, comprising:

two contact clips, arranged at a distance from one another, a contact element being insertable in between the two contact clips on an edge area of the electrical connection;

a body, at least a portion of the body being located between the contact clips, the body being at least partially composed of a ferromagnetic material; and at least one further body at least partially composed of a ferromagnetic material, the at least one further body being arranged on one side of one of the two contact clips, facing away from the other one of the two contact clips, wherein at least one gap is formed between the at least one further body and the body, at least a section of the body has an H-profile in an axial cross section and upper limbs of the H-profile rest on a respective contact clip.

2. The switching device as claimed in claim 1, wherein the at least one further body is in direct contact with the contact clips and arranged on one side of one of the two contact clips, facing away from the other one of the two contact clips.

3. The switching device as claimed in claim 1, further comprising:

two further bodies, each at least partially composed of a ferromagnetic material, each further body being arranged on one side of a respective one of the two contact clips, facing away from a respective other one of the two contact clips.

4. The switching device as claimed in claim 3, wherein at least one gap is formed between the at least one further body and the body.

5. The switching device as claimed in claim 1, further comprising:

two further bodies, each at least partially composed of a ferromagnetic material, each further body being arranged on one side of a respective one of the two contact clips, facing away from a respective other one of the two contact clips.

6. The switching device as claimed in claim 5, wherein at least one gap is formed between the at least one further body and the body.

7. The switching device as claimed in claim 1, wherein the electrical appliance is a circuit breaker.

8. The switching device as claimed in claim 1, wherein the location of the body between the contact clips couples the contact clips together.

9. The switching device as claimed in claim 1, wherein the body is suspended between the contact clips without a mechanical fastener.

* * * * *